US005640806A

United States Patent [19]

Hall

[11] Patent Number: 5,640,806

[45] Date of Patent: Jun. 24, 1997

[54] CABLE SLIDE GATE

[76] Inventor: Richard Hall, 19202 DesMoines Memorial Dr., Sea Tac, Wash. 98148

[21] Appl. No.: 487,334

[22] Filed: Jun. 7, 1995

[51] Int. Cl.[6] ..... E05F 11/54

[52] U.S. Cl. ..... 49/360

[58] Field of Search ..... 49/358, 360; 474/166, 474/167, 174, 189

[56] References Cited

U.S. PATENT DOCUMENTS

| | | | |
|---|---|---|---|
| 182,322 | 9/1876 | Norcross | 474/174 |
| 620,478 | 2/1899 | Mittinger | 474/174 |
| 4,296,570 | 10/1981 | Balbach et al. | 49/360 |
| 4,313,281 | 2/1982 | Richmond | 49/360 X |
| 4,738,052 | 4/1988 | Yoshida | 49/360 X |
| 5,076,012 | 12/1991 | Richmond et al. | 49/358 X |
| 5,127,190 | 7/1992 | Hein et al. | 49/360 X |

FOREIGN PATENT DOCUMENTS

| | | | |
|---|---|---|---|
| 581225 | 11/1977 | U.S.S.R. | 49/360 |
| 1158734 | 5/1985 | U.S.S.R. | 49/360 |

*Primary Examiner*—Kien T. Nguyen
*Attorney, Agent, or Firm*—Thomas W. Secrest

[57] ABSTRACT

The subject is a slide gate or a slide door. There is a DC electric motor which is battery powered. The source of electricity can be from an AC power source such as 110 or 120 volts. A transformer and a converter change the voltage to about 24 volts and rectify the current from alternating current to direct current. There is the electric motor and gear box combination connecting with a drive pulley. Further, there is a pulley on a spaced-apart post. A cable runs around the two pulleys. The drive pulley is connected to the slide gate or the slide door for moving the gate or door.

21 Claims, 8 Drawing Sheets

CABLE SLIDE GATE

CROSS REFERENCES TO RELATED PATENT APPLICATIONS (if applicable)

There is no pending related application.

This application has two patents:

| Patent Number | Issuing Date |
|---|---|
| 4,665,650 | 1987 May 19 |
| 4,934,203 | 1990 June 19. |

The applicant filed a patent application on 1991 Feb. 13, Ser. No. 07/655,310, entitled "A Slidable Gate", now abandoned.

STATEMENT AS TO RIGHTS TO INVENTIONS MADE UNDER FEDERALLY SPONSORED RESEARCH AND DEVELOPMENT (if any)

The subject invention was developed with private funds and did not receive any assistance from the United States Government.

BACKGROUND OF THE INVENTION

1. Field of the Invention

The field of this invention is a slide gate. There are many applications for a slide gate. For example, there may be a fence or a wall having a large opening. A truck or a trailer or an automobile or a large piece of equipment can pass through this large opening. The large opening may lead to a parking facility or an equipment storage facility or to a building.

In many instances a swing gate may be useful.

In some instances a barrier arm may be useful.

This particular slide gate is useful for sliding a barrier across the opening to prevent movement of an article or for sliding the barrier away from the opening to allow an article to pass through the opening.

It is conceivable that this slide gate can be used on the doors to an airplane hanger. Normally, the doors to an airplane hanger are large doors and are suspended. With this slide door mechanism or slide gate mechanism the suspended doors to an airplane hanger can be moved so as to open the passageway into and out of the airplane hanger. Also, the suspended doors can be moved so as to seal the passage into and from the airplane hanger.

The doors on a building will be, generally, suspended from a track on the building. The slide mechanism will function on suspended doors.

A slide gate is generally on rollers or wheels or tires and the equivalent and there is a supporting guide structure for the upper part of the slide gate. The slide gate mechanism will move the slide gate so as to seal off the opening or move the slide gate so as to let passage of an article through the opening.

2. Description of the Prior Art

A patent search was not made prior to the preparation of this patent application.

A number of years ago, the applicant filed a patent application entitled "A Slidable Gate", on filing date 13 Feb. 1991 and under Ser. No. 07/655,310. This patent application was abandoned.

SUMMARY

A brief summary of the invention is that there are two spaced-apart pulleys.

There is a drive pulley.

There is a first separate support. The first separate support may be a support plate. There is mounted on the support plate a combination gear box and electric motor. Also, there may be mounted on the support plate the electrical controls and the battery for the electric motor. The gear box has an output shaft. On this output shaft there is mounted the drive pulley.

There is a second separate support spaced apart from the first separate support. On the second separate support there is a driven pulley.

A cable stretches between the two pulleys and is wrapped around the drive pulley and the driven pulley.

The drive pulley, in cross-section, has an elliptical configuration or half of an ellipse. This elliptical configuration is effective for increasing the friction between the drive pulley and the cable. The applicant has found that the steel cable should have a plastic coating such as a nylon coating. The combination of the cable with the nylon coating, and the elliptical groove in the drive pulley is effective for moving the cable.

There is a means for attaching the cable to a gate or a door. The gate may be on rollers and supported in an upright position. Also, the door may be suspended.

OBJECTS AND ADVANTAGES

One of the objects and advantages is a slide mechanism for a gate having two spaced-apart pulleys so as to lessen the possibility of a cable rubbing against itself and fraying and destroying itself;

Another object is to have two spaced-apart supports with the drive pulley on the first support and the driven pulley on the second support for moving the slide gate or the slide door;

A further advantage is the employment of a low-voltage direct current motor which has the inherent safety feature of lessening the possibility of fire and an electrical short circuit and electric shock;

A further advantage is a back-up battery for operating a direct current operated DC electric motor to operate the slide mechanism for the slide gate or the slide door in case the 110–120 volt alternating current source has a power failure from a commercial electrical source;

A further advantage is the use of 110–120 volt AC power source which is converted to a 24 volt DC to charge a 24 volt battery for operating the direct current electric motor;

An additional advantage is that many components are mounted on a flat panel or support plate and which mounting is easily accomplished and performed;

Another advantage is that the components upon being mounted on the flat panel are easily accessible for ease or replacement and/or repair;

An additional important object is a pulley having an elliptically shaped groove for more positive traction with a cable; and, Another advantage is the employment of a cable with a plastic coating so as to realize better traction with the pulley having the elliptically shaped groove.

An especial object and advantage is the use of a keyless bushing on the drive shaft for the drive pulley. If there be a failure in the source of electricity a nut can be loosened and the drive pulley turned manually so as to manually move the slide gate.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DESCRIPTION OF THE PREFERRED EMBODIMENTS

Figure 1:
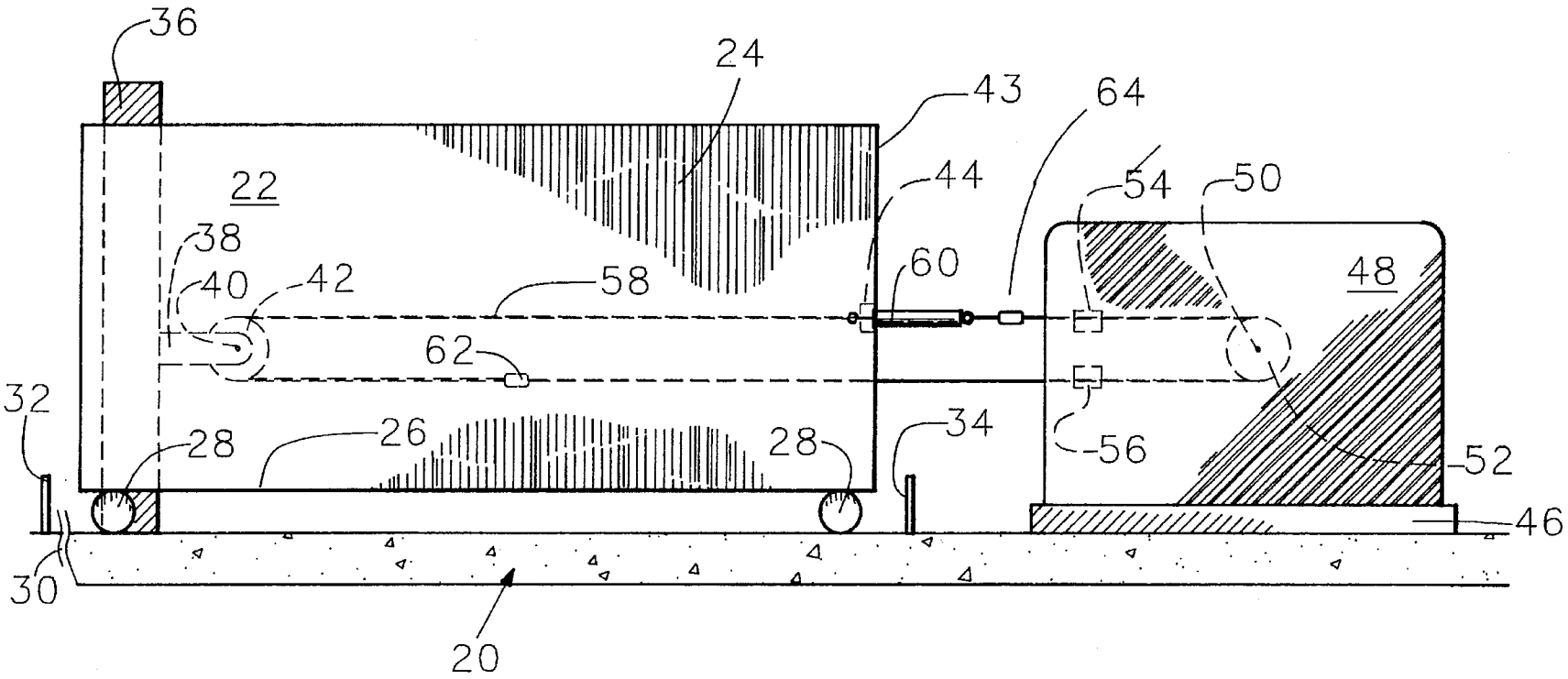
FIG. 1 is a schematic side elevational view of the slide gate as it moves on the ground on support wheels and is connected to a cable.
Figure 2:
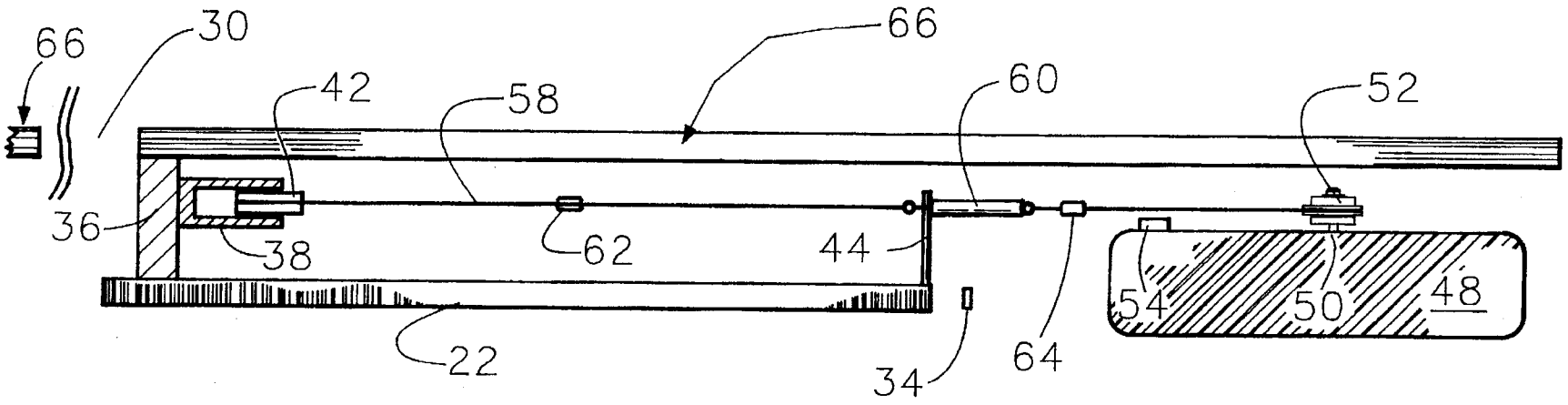
FIG. 2 is a schematic top plan view of the slide gate which is connected to a cable.

In FIGS. 1 and 2 there is a schematic illustration of a slide gate which moves on the ground.

Reference numeral 20 refers to the ground such as pavement, a floor, asphalt, earth and the like.

There is a slide gate 22 having a barricade 24. The barricade 24 may be a solid panel, wire mesh, rods and bars and the like.

The slide gate 22 has a base 26 which is supported on wheels 28.

In the lower left of FIG. 1 and the left of FIG. 2 there is schematically illustrated an opening 30. The opening may be closed by the slide gate 22. With the slide gate 22 removed the opening 30 is open for the passage of an article through the opening.

There is an outer stop 32 at the left of FIG. 1 for stopping the leftward movement of the slide gate 22. Also, it is seen that there is an inner stop 34 for restricting the rightward movement of the slide gate 22. The gate is stopped with limit switches 54 and 56 that control the flow of electric power to the motor.

On the other side of the slide gate 22 there is an upright support 36. Projecting rightwardly from the upright support 36 there is a support arm 38. The support arm 38 supports an axle 40. There is rotatably positioned on the axle 40 a driven pulley 42. The upright support 36 supports the support arm 38 which supports the driven pulley 42.

The slide gate 22 has an upward side 43 on the right. There is an attaching means 44 positioned on the side 43.

To the right of the slide gate 22 there is a support comprising a base 46 for supporting an upright panel 48. The base 46 may rest on the ground 20 or may be positioned on a suitable support or attached to upright panel 48 from a wall or post.

On the panel 48 or support plate 48 there is an axle 50. A rotatable drive pulley 52 is positioned on the axle 50.

There is positioned on the panel 48 an inner switch 54 and an outer switch 56. A cable 58 wraps around the driven pulley 42 and also around the drive pulley 52. There is in the cable 58 a cable tensioning means 60. The cable tensioning means makes it possible to adjust the tension in the cable to a desired tension.

On the cable 58, and near the pulley 42, there is an outer switch activator 62.

On the cable 58, and near the upright support plate 48, there is an inner switch activator 64.

In FIG. 2 it is seen that there is a divider 66 having an opening 30. The divider 66 may be a wall such as a brick wall or concrete wall, a wood panel, a barbed wire or woven wire divider or wood rail divider to name a few such types of walls and dividers.

In FIG. 1 it is seen that the slide gate 22 is near the panel 48. The opening 30 is open. It may be desirable to move the slide gate 22 to cover or to close the opening 30. The drive pulley 52 can be rotated in a counter-clockwise direction so as to move the slide gate 22 to the left and to cover the opening 30. As a result the outer switch activator 62 moves towards the panel 48. The outer switch activator 62 upon contacting the outer switch 56 opens the electrical circuit and the pulley 52 ceases to rotate. The opening 30 is now covered by the slide gate 22.

With the slide gate 22 closing the opening 30, it may be desirable to move the slide gate 22 to the right to open the opening 30. The pulley 52 is rotated in a clockwise direction and the slide gate 22 moves towards the support plate 48. The inner switch activator 64 upon contacting the inner switch 54 opens the electrical circuit and the pulley 52 stops rotating.

Gates are mounted in a number of ways.

Gates may be mounted on rollers attached to the fence. Then wheels are attached to the end of the gate for supporting the gate. The wheels may run on a track.

Shorter gates can be cantilevered across a driveway with rollers attached to a fence or wall.

Further, doors can be hung from rollers on a track attached to a wall.

Figure 3:
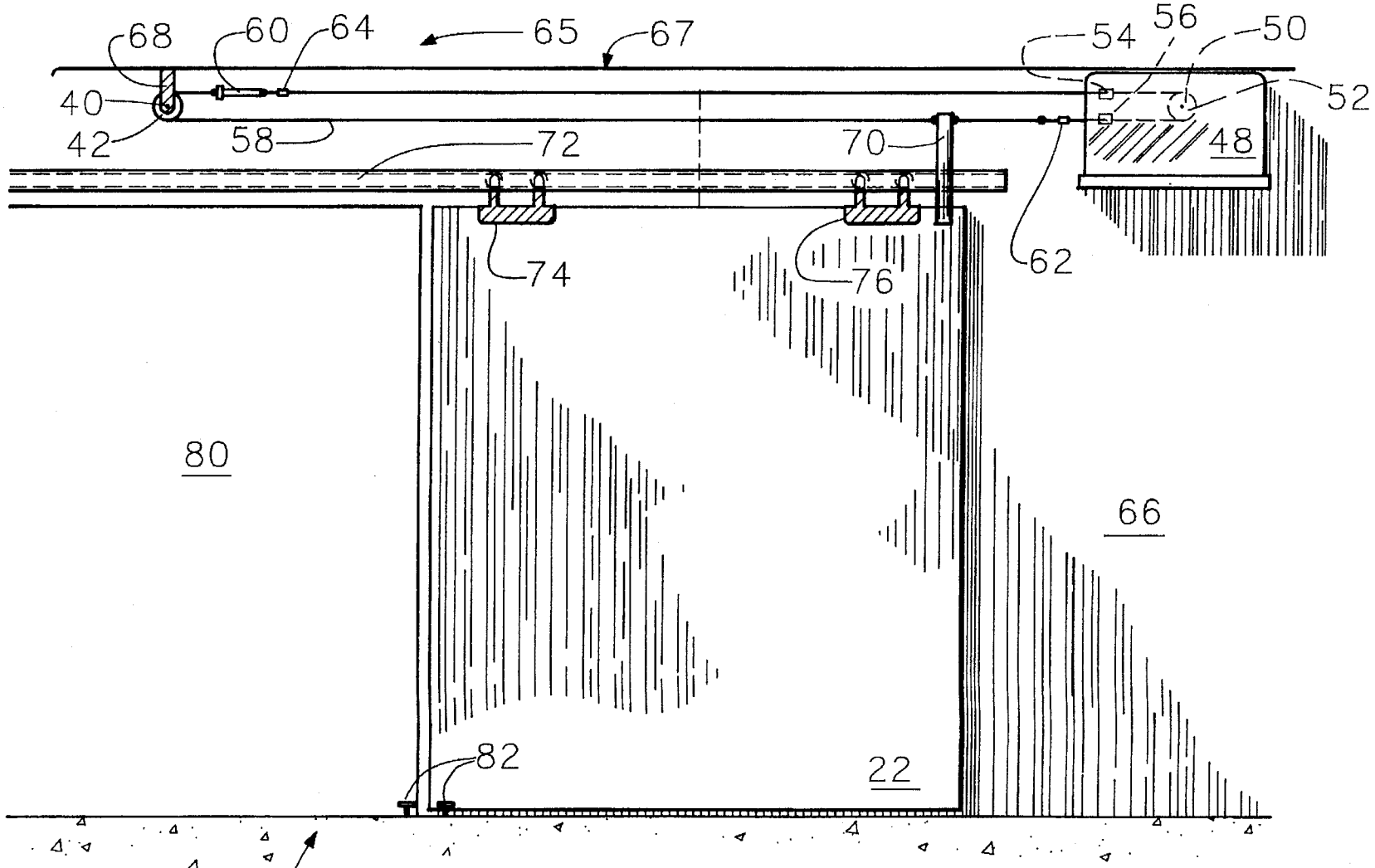
FIG. 3 is a schematic side elevational view or a another version of the slide gate which is suspended from a track and is connected to a cable.
Figure 4:
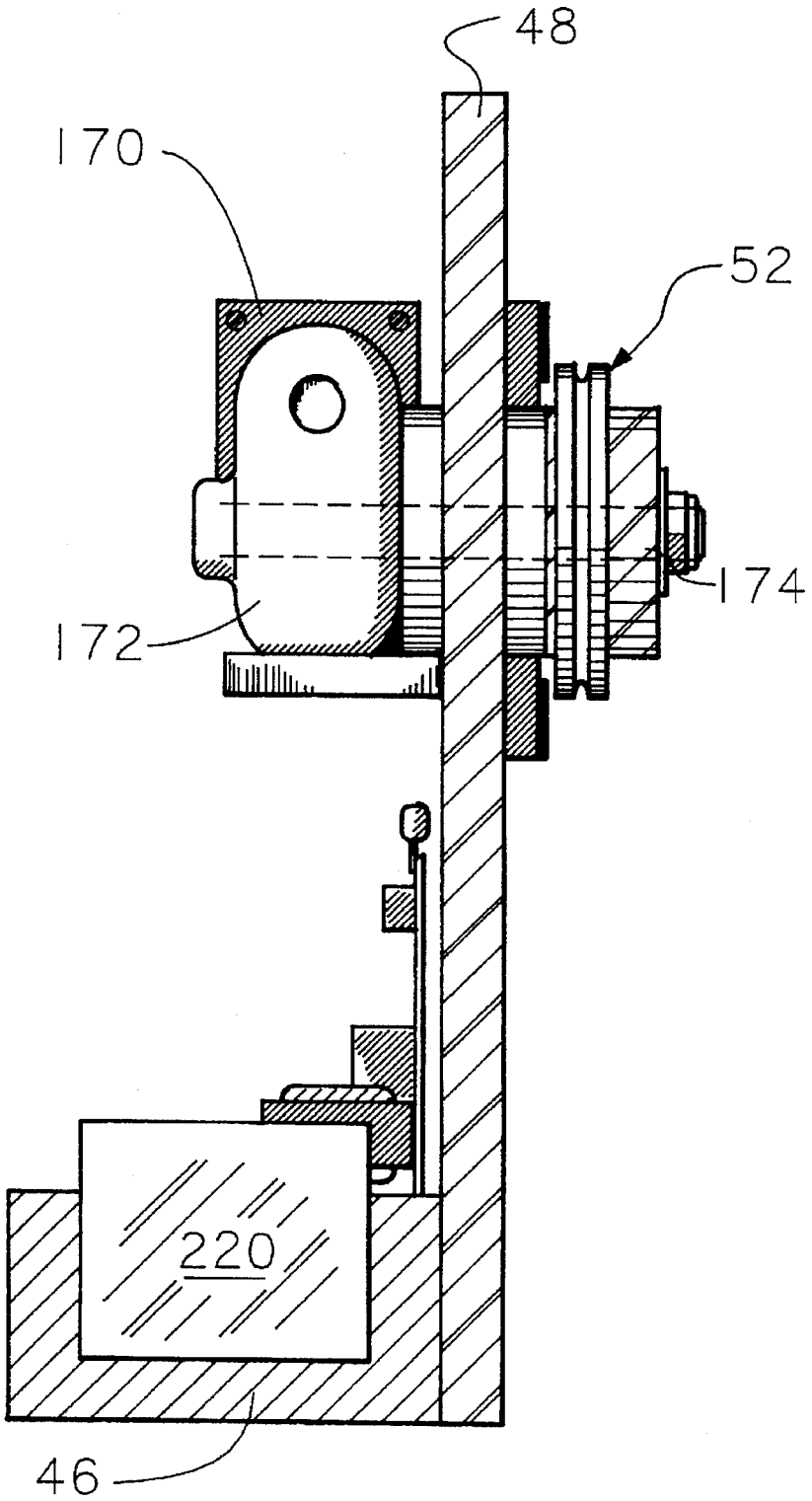
FIG. 4 is an end elevational view of a unit comprising a base, a panel or support plate, a storage area for a battery, a combination of an electric motor and a gear box and an output drive shaft from the gear box.

In FIG. 3 there is schematically illustrated a slide gate 22 which is suspended from an overhead track. There is a divider wall 66 which may be a partition between properties. Or, the divider wall 66 may be positioned between rooms in a building.

In a building 65 there is a structure having a ceiling 67 or an overhead structure. There is suspended from the ceiling 67 or wall a support 68.

On the support 68 there is an axle 40. A rotatable driven pulley 42 is positioned on the axle 40.

There is the panel 48 having a drive shaft 50. There is positioned on the drive shaft 50 a drive pulley 52. The panel 48 is supported on the building 65.

On the panel 48 there is positioned an inner switch 54 and an outer switch 56.

There is a cable 58 extending around the drive pulley 52 and around the driven pulley 42. In the cable 58 there is the tensioning means 60.

On the cable 58 there is the inner switch activator 64. Also, on the cable 58 there is the outer switch activator 62.

There is positioned on the cable 58 a depending connecting arm 70 which connects with the slide gate 22. With the movement of the cable 58, the connecting arm 70 moves and the slide gate moves.

There is an overhead track 72. The overhead track has a first depending hanger 74 which connects with the slide gate 22. The overhead track 72 has a second depending hanger 76 which connects with the slide gate 22.

Naturally, the hangers 74 and 76 have rollers or wheels which can rotate and move on the overhead track 72.

The divider wall 66 has an opening 80 as illustrated in the left part of FIG. 3.

On the ground 20 or floor 20 there are guides 82 for the slide gate 22. These guides assist in directing the movement of the slide gate 22.

In operation the drive shaft 50 rotates and thereby the drive pulley 52 rotates. This moves the cable 58. With the cable 58 moving the connecting arm 70 moves thereby moving the slide gate 22.

Assume that the opening 80 is open and that the slide gate 22, in FIG. 3, is to the right of the opening 80. It is desired to move the slide gate 22 to the left to cover the opening 80.

The drive shaft 50 and the pulley 52 can rotate in a clockwise direction. The connecting arm 70 moves leftwardly towards the depending support 68 and thereby the slide gate 22 moves to the left.

The inner switch activator 64 moves on the cable toward the inner switch 54 on the panel 48. The activator 64 upon contacting the switch 54 opens the electric circuit. The drive shaft 50 and the pulley 52 stop moving. At this time, the slide gate 22 should be covering the opening 80 to seal from each other the areas on the two sides of the divider wall 66.

Assume that the slide gate 22 is covering the opening 80 and it is desired to move the slide gate 22 so there can be a passageway through the opening 80. The drive shaft 50 and the drive pulley 52 rotate in a counter-clockwise direction. The outer switch activator 62 moves to the right and upon contacting the outer switch 56 the electrical circuit is opened. The drive shaft 50 and the drive pulley 52 stop rotating. Also, the slide gate 22 has been moved away from the opening 80 so as to allow passageway through the opening 80.

Figure 5:
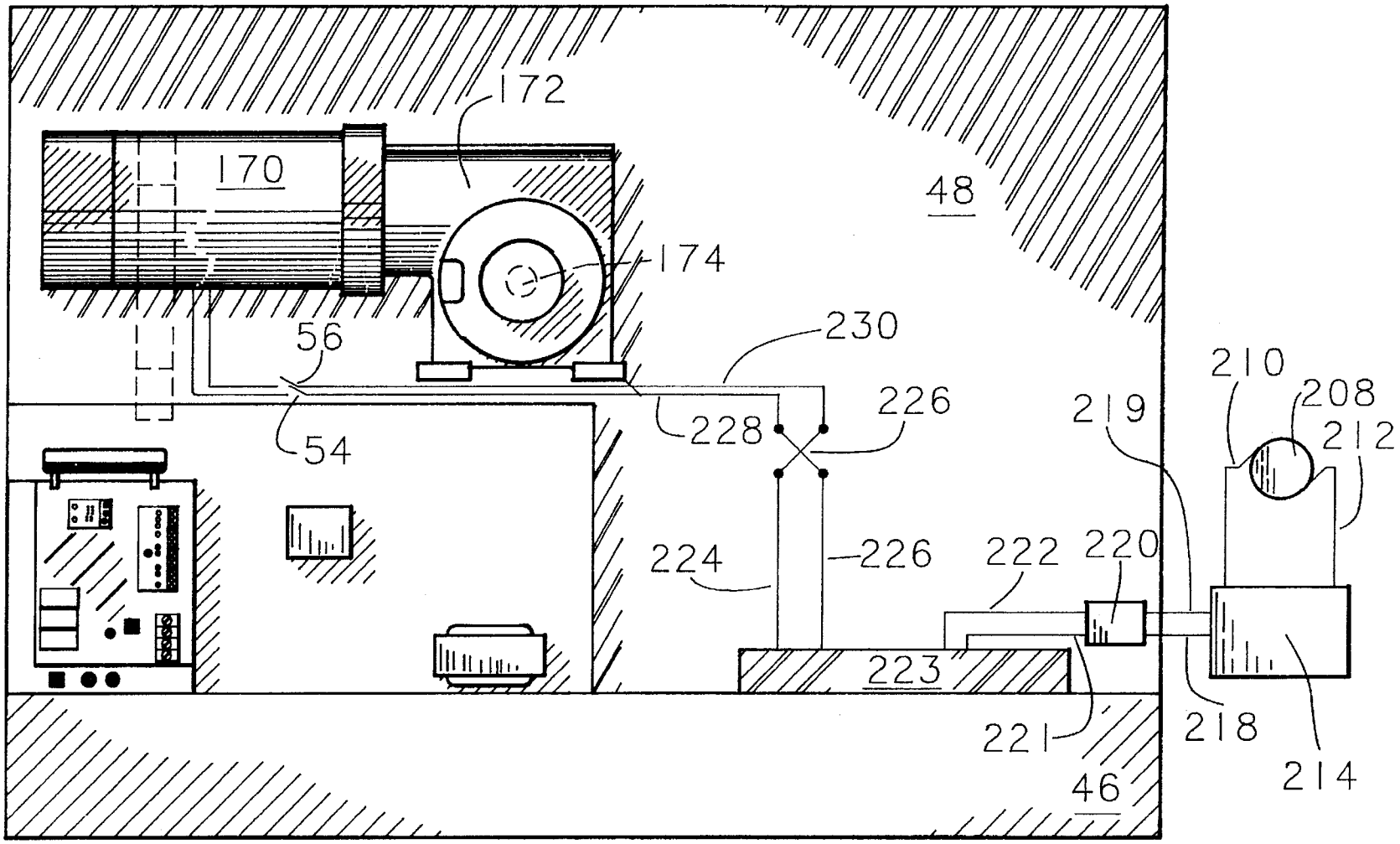
FIG. 5 is a front elevational schematic view illustrating the base, battery, panel or support plate, and a combination of an electric motor and differential gear box operatively driven by the electric motor.

In FIG. 5 is a schematic illustration of the electrical controls and motor.

There is a base 46 and a mounting panel 48.

There is mounted on the panel 48 an electric motor 170 which connects with a differential gear box 172. The motor 170 is in a driving relationship to the differential gear box 172. The differential gear box 172 has an output shaft 174.

There is operatively connecting with the output shaft 174, the pulley 52 having an elliptical groove.

The pulley 52 I use has a four-inch external diameter. The opening to the elliptical groove 178 is 3/16-inch, viz., the size of the cable. The depth of the elliptical groove 178 is the diameter of the cable or 3/16-inch. Normally, a groove in a pulley, in a cross-sectional view, is of a v-configuration. The pulley 52, in a cross-sectional view, has a groove of an elliptical configuration. The cable 58 does not contact the bottom of the groove 178 in the pulley 52.

The size of the pulley, the opening to the groove and the depth of the groove can vary depending upon the use of the pulley.

Figure 7:
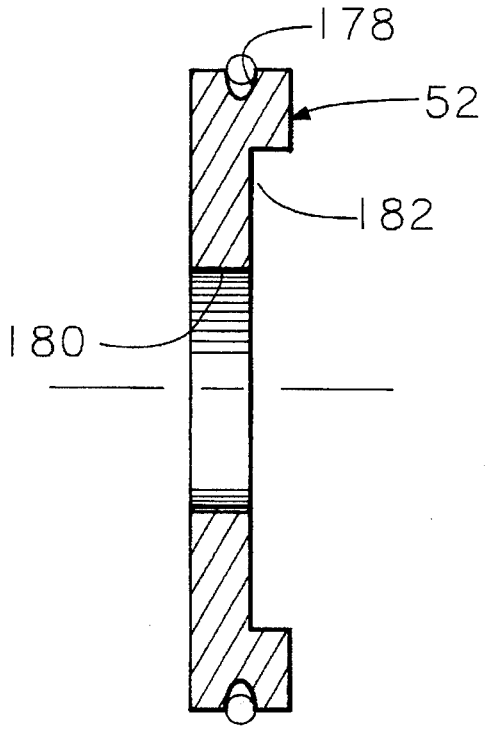
FIG. 7 is a cross-sectional view of the pulley and illustrates the elliptical groove in the pulley for receiving a cable and it is to be noted that the cable does not touch the bottom of the groove in the pulley.

In FIG. 7 it is seen that the pulley 52 has a central passageway 180. On the outer surface of the pulley 176 there is a recess 182.

Figure 6:
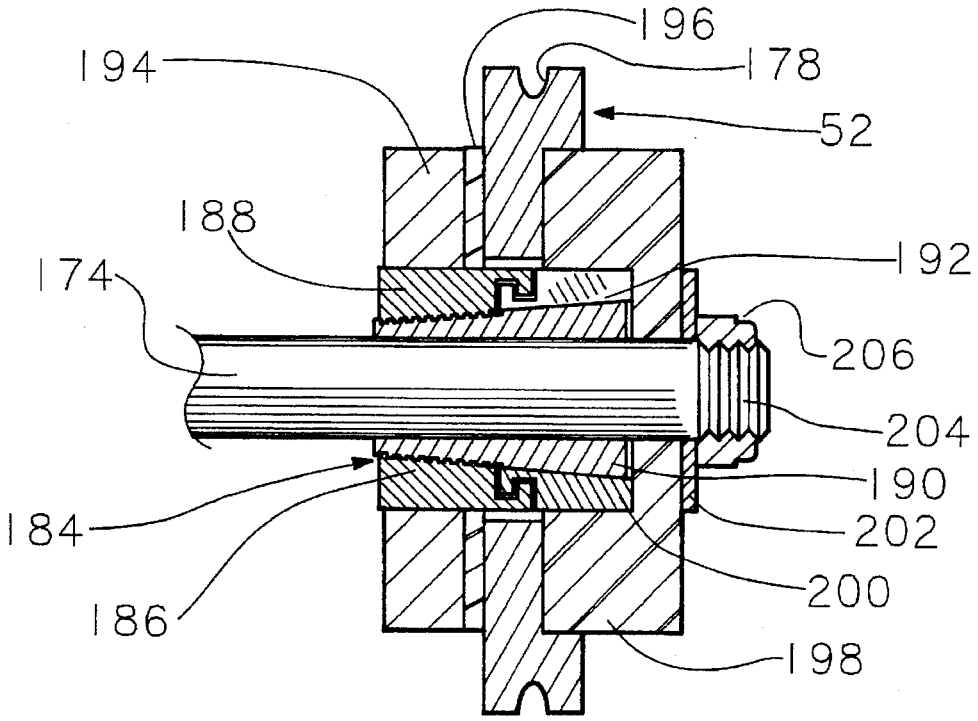
FIG. 6 is a fragmentary cross-sectional view of the components for attaching a pulley to the output drive shaft from the differential gear box and illustrates the elliptical groove in the pulley.

With respect to FIG. 6 it is seen that 174 is a drive shaft or the output shaft from the differential gear box 172. A clutch mechanism 184 is mounted on the drive shaft 174. The clutch mechanism makes it possible for the pulley 52 to rotate with the rotation of the drive shaft 174. The clutch mechanism 184 is a keyless mechanism. It operates on a pressure fit.

The clutch mechanism 184 comprises an inner collet-like element 188. 188 has a central passageway slightly larger in internal diameter than the external diameter of the drive shaft 174. This makes it possible to slip 188 easily onto the drive shaft 174. The left part of 188 has external threads on 192. The right part of 188 tapers at tapered surface 190 which increases in thickness upon going from left to right.

There is an outer sleeve 187. The outer sleeve has an inner tapered surface 191. The thickness of the outer sleeve 187 decreases upon going from left to right. Actually, 187 comprises three separate outer sleeves. These three separate outer sleeves extend through an arc of about 115 degrees to 119 degrees.

The tape 190 of the inner collet 188 and the tape 191 of the outer sleeve 187 are designed to slide with respect to each other.

It is seen that the outer sleeve 187 near the left end has a recess in the outer surface.

There is a nut 186 having internal threads 193. These internal threads 193 match the external threads 192 of the inner collet 188.

Also, the nut 186 has a finger on the right end which fits into the recess in the outer sleeve 187. The collet 188 has a pressure plate 194 on its outer surface. Further, to the left of the collet 188 there is a series of shoulders 200 which make it possible to engage a wrench.

With the wrench rotating the shoulder 200, in the appropriate direction, the inner collet 188 moves to the right. The finger on the inner end of the inner collet 188 engages the outer sleeve 187. The tapered surfaces 190 and 191 engage each other. With the rotation of the shoulder 200 by a wrench, the inner collet 188 moves to the left and the nut moves to the right. The tapered surface 191 of the nut 186 bears against the tapered surface 190 of the inner collet 188. This forces the inner surface of the collet 188 against the exterior or outer surface of the drive shaft 174. In this manner, the inner collet 188 is squeezed firmly against the outer surface of the drive shaft 174 so as to fix in the position the inner collet 188 onto the shaft 174.

A friction plate 196, also known as a clutch plate, has a central passageway having an internal diameter slightly than the external diameter of the nut 186. The clutch plate 196 can be moveably positioned on the nut 186.

There is a pulley 52 having an inner central passageway 180.

The inner central passageway 180 has a internal diameter slightly larger than the external diameter of the nut 186. This makes it possible to slide the pulley 52 over the nut 186. Then, there is a bearing plate 198 having a central passageway. The central passageway has an internal diameter slightly larger than the external diameter of the drive shaft 174. The bearing plate 198 can slide over the drive shaft 174 and contact the pulley 52.

There is a washer 202 having a central passageway of a slightly larger diameter than the external diameter of the drive shaft 174. This washer 202 can slide over the drive shaft 174.

A jam nut 206 can be rotated onto the external threads 175 and the drive shaft 174. With the tightening of the jam nut 206 the washer 202 is squeezed against the bearing plate 198. The bearing plate 198 is squeezed against the pulley 52. The pulley 52 is squeezed against the clutch plate 196. The clutch plate 196 is squeezed against the pressure plate 194. To definitely position the pressure plate and the inner collet 188 onto the shaft 174, the nut 186 is rotated so as to move the inner collet 188 to the left and to move the outer sleeve 187 to the right. The tapered surface of 190 and 191 press the inner collet 188 onto the outer surface of the drive shaft 174. This definitely positions the inner collet 188 on the drive shaft 174. Further, there is definitely positioned the pressure plate 194 onto the drive shaft 174. This explains the rotation of the pressure plate 194 with the rotation of the drive shaft 174. With the rotation of the jam nut 176 so as to move the pulley 52 to contact the clutch plate 196 and to contact the pressure plate, the pulley 52 is definitely positioned with respect to the drive shaft 174. Now, with the rotation of the drive shaft 174, the pulley 52 will rotate and the cable 58 will move.

Assume the electricity stops and there is no electricity to electric motor 170. The gate 24 or the barricade 24 cannot be moved. Also, assume that it is necessary to move the gate. There is provision for this. The jam nut 206 can be rotated on the external threads 175 of the drive shaft 174. The jam nut 206 is loosened on the drive shaft 174. The washer 202 is not bearing against the bearing plate 198. The bearing plate 198 is not forcing the pulley 52 against the clutch plate 196. The clutch plate 196 is not bearing against the pressure plate 194. The result is that the pulley 52 can be rotated on the nut 186. The result is that the gate 24 or barricade 24 can be manually moved. This is a safety feature.

With respect to FIG. 5 there is a schematic illustration of the electrical wiring diagram.

The motor 170 is a direct current electric motor. The motor I use is a 24-volt DC motor.

There is a source of electricity 208. Generally, the source of electricity is from a generator and comes over the lines as an AC current or alternating current at approximately 110–120 volts. The generator 208 has lines 210 and 212 which connect with the transformer 214 for transforming the voltage from 110–120 volt AC to 20 volts AC.

The transformer 214 has output lines 218 and 219. These lines connect to a rectifier 220 for converting 28 volts AC to 28 volts DC.

The rectifier 220 connects by electrical lines 221 and 222 to the 24-volt battery 223.

The battery 223 has output lines 224 and 226 which connect with a switch 226. The switch 226, by lines 228 and 230, connects with the electric 24-volt DC motor 176.

It can be seen that by changing the polarity of the contacts of the switch 226 that output shaft 174 can be made to rotate in a clockwise direction or can be made to rotate in a counter-clockwise direction.

A 24-volt DC motor is an acceptable motor in use in the electrical industry. If the source of electricity 208 fails then it is possible to operate the slide gate from the battery 223 to either close the gate or to open the gate, as the situation dictates.

In the electrical line 228 there is the switch 54. In the electrical line 230 there is the switch 56.

The electrical lines 221 and 222 connect the rectifier 220 with the battery 223. The balance of the electrical circuit including the electric motor 170 has been described.

The cable 58 comprises a metal core such as steel strands covered by a plastic such as nylon. This combination gives a good gripping quality with the drive pulley 52 so that there is satisfactory friction between the cable 58 and the drive pulley 52.

Figure 8:
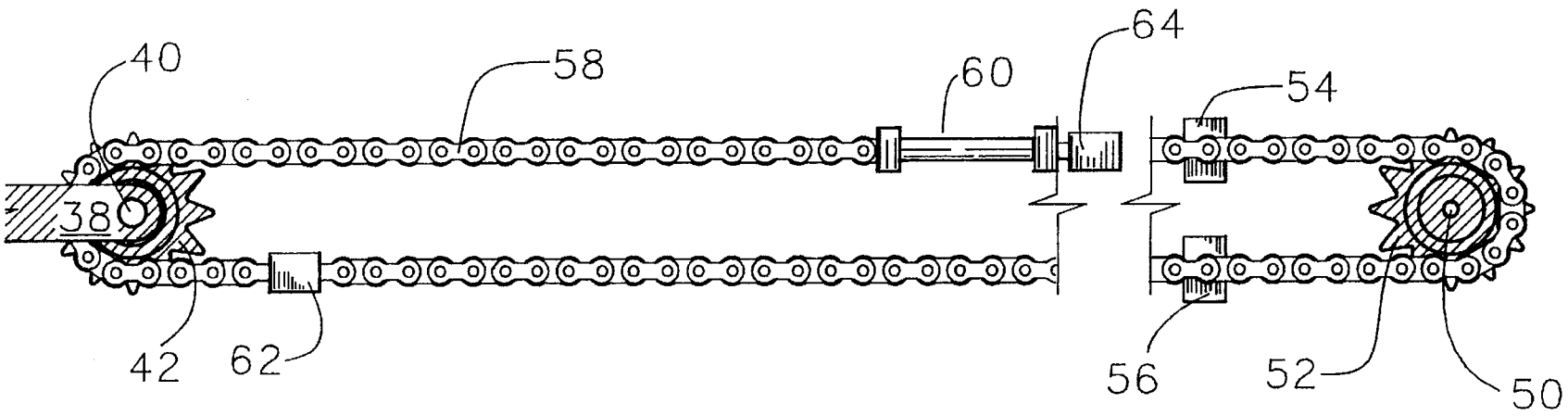
FIG. 8 is a schematic illustration of a modification of the parts for moving the slide gate by means of a sprocket and chain instead of a pulley and a cable; and, FIG. 9 is a schematic drawing of another specie of the cable in the elliptical groove in the pulley.

In FIG. 8 there is illustrated the use of sprockets and chains instead of pulleys.

There is a drive sprocket 52 instead of the pulley 52.

There is a chain 58 in place of the cable 58.

There is a driven sprocket 42 instead of the driven pulley 42.

There is a drive shaft 50 and a driven shaft 40.

There are switch activators 62 and 64.

There are switches 54 and 56.

With respect to FIG. 7 it is seen that the pulley 52 has an elliptically shaped groove 178. The cable 58 is in the elliptically shaped groove. However, in FIG. 7 it is seen that the cable 58 does not contact the bottom of the groove 178. The cable 58 contacts the sides of the groove 178.

Figure 9:
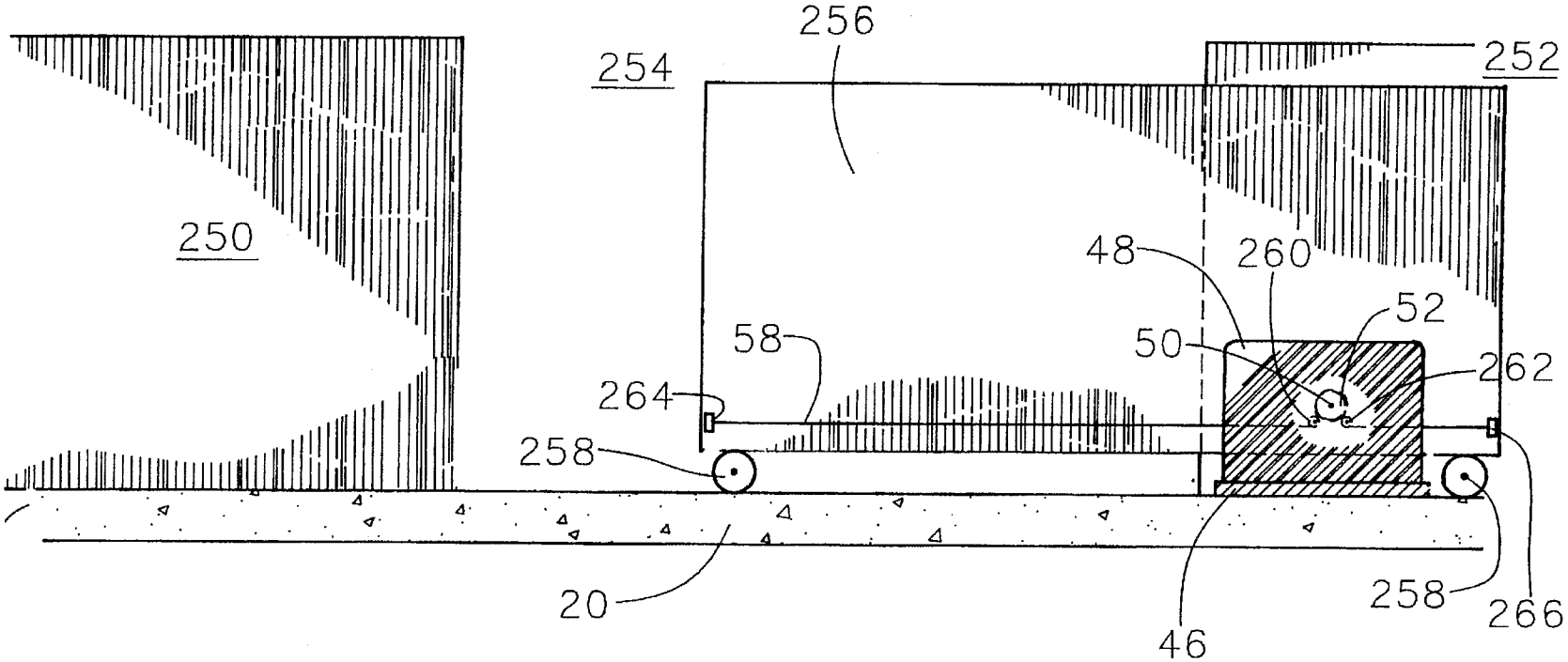

In FIG. 9 it is seen that there is a modification of the drive unit for the cable and the cable.

There is a ground 20 on which the moveable gate 226 rests and moves.

There is the panel 48, which has the components of FIG. 5 and will not be further described, and which is stationary on the ground.

The moveable gate 256 rests on spaced-apart wheels 258.

There is the drive shaft 50 from the output transmission. On the drive shaft 50, there is a drive pulley 52.

On the right of the gate 256 there is a connector 266. On the left of the gate 256 there is a connector 264.

To the left of the drive pulley 52 there is a left idler pulley 260. To the right of the drive pulley 52 there is right idler pulley 262.

A cable 58 connects with the connector 266 and also with the connector 264. This cable 58 passes underneath the idler pulley 260 and over the drive pulley 52 and underneath the right idler pulley 262.

There is a left wall 250 and a right wall 252. The left wall 250 and the right wall 252 define an opening 254.

With the rotation of the drive shaft 50 and the drive pulley 52, the moveable gate 256 can be moved to the left or can be moved to the right.

With the clockwise rotation of the drive pulley 52, the moveable gate 256 moves to the left.

With the counter-clockwise rotation of the drive pulley 52, the moveable gate 256 moves to the right.

A statement of the invention is as follows.

A gate apparatus comprising a movable gate; a first means for positioning said gate; a cable; a second means for operatively connecting said cable to said gate; a third means for moving said cable to move said gate; said third means comprising a drive pulley for moving said cable; a fourth means for receiving and for positioning said cable and for allowing said cable to move; an electric motor operatively connecting with a gear box; said gear box operatively connecting with said drive pulley; an electrical circuit operatively connecting with said electric motor; said electrical circuit having a first switch means and a second switch means; a fifth means for operatively connecting with said first switch means to restrict movement of said gate; a sixth means for operatively connecting with said second switch means to restrict movement of said gate; said fifth means being positioned on said cable; said sixth means being positioned on said cable; a cable tensioning means operatively connecting with said cable; said electrical circuit comprising an electric storage battery operatively connecting with said electric motor; a switch in said electrical circuit to direct an output shaft or said electric motor to rotate in two directions; a transformer in said electrical circuit for changing the input voltage to the transformer to an output voltage compatible with the voltage required by said electric motor; a seventh means in said electrical circuit for converting alternating current to direct current; said drive pulley having, in a cross-sectional view, an elliptically shaped groove; said cable having a plastic exterior; said movable gate being positioned on support wheels; and, said support wheels and said cable assist in maintaining said gate in a desired position.

A gate apparatus comprising a movable gate; a first means for positioning said gate; a cable; a second means for operatively connecting said cable to said gate; a third means for moving said cable to move said gate; said third means comprising a drive pulley for moving said cable; a fourth means for receiving and for positioning said cable and for allowing said cable to move; an electric motor operatively connecting with a gear box; said gear box operatively connecting with said drive pulley; an electrical circuit operatively connecting with said electric motor; said electrical circuit having a first switch means and a second switch means; a fifth means for operatively connecting with said first switch means to restrict movement of said gate; a sixth means for operatively connecting with said second switch means to restrict movement of said gate; said fifth means being positioned on said cable; said sixth means being positioned on said cable; a cable tensioning means operatively connecting with said cable; said electrical circuit comprising an electric storage battery operatively connecting with said electric motor; a switch in said electrical circuit to direct an output shaft or said electric motor to rotate in two directions; a transformer in said electrical circuit for changing the input voltage to the transformer to an output voltage compatible with the voltage required by said electric motor; a seventh means in said electrical circuit for converting alternating current to direct current; said drive pulley having, in a cross-sectional view, an elliptically shaped groove; said cable having a plastic exterior; said movable gate being suspended from a support; and, said support and said cable assist in maintaining said gate in a desired position.

A gate apparatus comprising a movable gate; a first means for positioning said gate; a cable; a second means for operatively connecting said cable to said gate; a third means for moving said cable to move said gate; said third means comprising a drive pulley for moving said cable; a fourth means for receiving and for positioning said cable and for allowing said cable to move; an electric motor operatively connecting with a gear box; said gear box operatively connecting with said drive pulley; an electrical circuit operatively connecting with said electric motor; said electrical circuit having a first switch means and a second switch means; a fifth means for operatively connecting with said first switch means to restrict movement of said gate; a sixth means for operatively connecting with said second switch means to restrict movement of said gate; said fifth means being positioned on said cable; said sixth means being positioned on said cable; a cable tensioning means operatively connecting with said cable; said electrical circuit comprising an electric storage battery operatively connecting with said electric motor; a switch in said electrical circuit to direct an output shaft or said electric motor to rotate in two directions; a transformer in said electrical circuit for changing the input voltage to the transformer to an output voltage compatible with the voltage required by said electric motor; a seventh means in said electrical circuit for converting alternating current to direct current; said drive pulley having, in a cross-sectional view, an elliptically shaped groove; said cable having a plastic exterior; said movable gate being an articulated gate; a guide channel operatively connecting with said movable gate; and, said guide channel and said cable cooperate to move and to maintain said articulated gate in a desired position.

A gate apparatus comprising a movable gate; a first means for positioning said gate; a cable; a second means for operatively connecting said cable to said gate; a third means for moving said cable to move said gate; said third means comprising a drive pulley for moving said cable; a fourth means for receiving and for positioning said cable and for allowing said cable to move; an electric motor operatively connecting with a gear box; said gear box operatively connecting with said drive pulley; an electrical circuit operatively connecting with said electric motor; said electrical circuit having a first switch means and a second switch means; a fifth means for operatively connecting with said first switch means to restrict movement of said gate; a sixth means for operatively connecting with said second switch means to restrict movement of said gate; said fifth means being positioned on said cable; said sixth means being positioned on said cable; a cable tensioning means operatively connecting with said cable; said electrical circuit comprising an electric storage battery operatively connecting with said electric motor; a switch in said electrical circuit to direct an output shaft or said electric motor to rotate in two directions; a transformer in said electrical circuit for changing the input voltage to the transformer to an output voltage compatible with the voltage required by said electric motor; a seventh means in said electrical circuit for converting alternating current to direct current; said drive pulley having, in a cross-sectional view, an elliptically shaped groove; said cable having a plastic exterior; said movable gate being an articulated gate; a guide channel operatively connecting with said movable gate; a spring means to assist in moving said articulated gate; said spring means being capable to move said articulated gate; and, said guide channel, said spring means and said cable cooperate to maintain said articulated gate in a desired position.

A process for making a gate apparatus and comprising forming a movable gate; forming a first means for positioning said gate; associating in an operative relationship said first means with said gate; selecting a cable; forming a second means for operatively connecting said cable to said gate; operatively connecting said cable to said gate; selecting a third means for moving said cable for moving said gate; operatively connecting said third means to said cable; selecting as said third means a drive pulley for moving said cable; selecting a fourth means for receiving and positioning said cable and for allowing said cable to move; operatively connecting an electric motor in a drive relationship to a gear box; operatively connecting said gear box in a drive relationship with said drive pulley; operatively connecting an electric circuit with said electric motor; forming said electric circuit with a first switch means and a second switch means; operatively connecting a fifth means with said first switch means to restrict movement of said gate; operatively connecting a sixth means with said second switch means to restrict movement of said gate; positioning said fifth means on said cable; positioning said sixth means on said cable; operatively connecting a cable tensioning means with said cable; incorporating an electric storage battery in said electrical circuit; incorporating a switch in said electrical circuit to direct an output shaft of said electric motor to rotate in two directions; incorporating a transformer in said electrical circuit for changing the input voltage to the transformer to an output voltage compatible with the voltage required by said electric motor; incorporating a seventh means in said electrical circuit for converting alternating current to direct current; forming said drive pulley to have, in a cross-sectional view, an elliptically shaped groove; selecting said cable having a plastic exterior; positioning said movable gate on support wheels; and, utilizing said support wheels and said cable to assist in maintaining said gate in a desired position.

A process for making a gate apparatus and comprising forming a movable gate; forming a first means for positioning said gate; associating in an operative relationship said first means with said gate; selecting a cable; forming a second means for operatively connecting said cable to said gate; operatively connecting said cable to said gate; selecting a third means for moving said cable for moving said gate; operatively connecting said third means to said cable; selecting as said third means a drive pulley for moving said cable; selecting a fourth means for receiving and positioning said cable and for allowing said cable to move; operatively connecting an electric motor in a drive relationship to a gear box; operatively connecting said gear box in a drive relationship with said drive pulley; operatively connecting an electric circuit with said electric motor; forming said electric circuit with a first switch means and a second switch means; operatively connecting a fifth means with said first switch means to restrict movement of said gate; operatively connecting a sixth means with said second switch means to restrict movement of said gate; positioning said fifth means on said cable; positioning said sixth means on said cable; operatively connecting a cable tensioning means with said cable; incorporating an electric storage battery in said electrical circuit; incorporating a switch in said electrical circuit to direct an output shaft of said electric motor to rotate in two directions; incorporating a transformer in said electrical circuit for changing the input voltage to the transformer to an output voltage compatible with the voltage required by said electric motor; incorporating a seventh means in said electrical circuit for converting alternating current to direct current; forming said drive pulley to have, in a cross-sectional view, an elliptically shaped groove; selecting said cable having a plastic exterior; suspending said movable gate from a support; and, utilizing said support and said cable in maintaining said gate in a desired position.

A process for making a gate apparatus and comprising forming a movable gate; forming a first means for positioning said gate; associating in an operative relationship said first means with said gate; selecting a cable; forming a second means for operatively connecting said cable to said gate; operatively connecting said cable to said gate; selecting a third means for moving said cable for moving said gate; operatively connecting said third means to said cable; selecting as said third means a drive pulley for moving said cable; selecting a fourth means for receiving and positioning said cable and for allowing said cable to move; operatively connecting an electric motor in a drive relationship to a gear box; operatively connecting said gear box in a drive relationship with said drive pulley; operatively connecting an electric circuit with said electric motor; forming said electric circuit with a first switch means and a second switch means; operatively connecting a fifth means with said first switch means to restrict movement of said gate; operatively connecting a sixth means with said second switch means to restrict movement of said gate; positioning said fifth means on said cable; positioning said sixth means on said cable; operatively connecting a cable tensioning means with said cable; incorporating an electric storage battery in said electrical circuit; incorporating a switch in said electrical circuit to direct an output shaft of said electric motor to rotate in two directions; incorporating a transformer in said electrical circuit for changing the input voltage to the transformer to an output voltage compatible with the voltage required by said electric motor; incorporating a seventh means in said electrical circuit for converting alternating current to direct current; forming said drive pulley to have, in a cross-sectional view, an elliptically shaped groove; selecting said cable having a plastic exterior; utilizing an articulated gate as said movable; operatively connecting a guide channel with said movable gate; and, utilizing said guide channel and said cable to move and to maintain said articulated gate in said desired position.

A process for making a gate apparatus and comprising forming a movable gate; forming a first means for positioning said gate; associating in an operative relationship said first means with said gate; selecting a cable; forming a second means for operatively connecting said cable to said gate; operatively connecting said cable to said gate; selecting a third means for moving said cable for moving said gate; operatively connecting said third means to said cable; selecting as said third means a drive pulley for moving said cable; selecting a fourth means for receiving and positioning said cable and for allowing said cable to move; operatively connecting an electric motor in a drive relationship to a gear box; operatively connecting said gear box in a drive relationship with said drive pulley; operatively connecting an electric circuit with said electric motor; forming said electric circuit with a first switch means and a second switch means; operatively connecting a fifth means with said first switch means to restrict movement of said gate; operatively connecting a sixth means with said second switch means to restrict movement of said gate; positioning said fifth means on said cable; positioning said sixth means on said cable; operatively connecting a cable tensioning means with said cable; incorporating an electric storage battery in said electrical circuit; incorporating a switch in said electrical circuit to direct an output shaft of said electric motor to rotate in two directions; incorporating a transformer in said electrical circuit for changing the input voltage to the transformer to an output voltage compatible with the voltage required by said electric motor; incorporating a seventh means in said electrical circuit for converting alternating current to direct current; forming said drive pulley to have, in a cross-sectional view, an elliptically shaped groove; selecting said cable having a plastic exterior; utilizing an articulated gate as said movable; operatively connecting a guide channel with said movable gate; operatively connecting a spring means to said articulated gate to assist in moving said articulated gate; selecting said spring means to be capable to move said articulated gate; and, utilizing said guide, said spring means and said cable to maintain said articulated gate in a desired position.

A gate apparatus made by the process and comprising forming a movable gate; forming a first means for positioning said gate; associating in an operative relationship said first means with said gate; selecting a cable; forming a second means for operatively connecting said cable to said gate; operatively connecting said cable to said gate; selecting a third means for moving said cable for moving said gate; operatively connecting said third means to said cable; selecting as said third means a drive pulley for moving said cable; selecting a fourth means for receiving and positioning said cable and for allowing said cable to move; operatively connecting an electric motor in a drive relationship to a gear box; operatively connecting said gear box in a drive relationship with said drive pulley; operatively connecting an electric circuit with said electric motor; forming said electric circuit with a first switch means and a second switch means; operatively connecting a fifth means with said first switch means to restrict movement of said gate; operatively connecting a sixth means with said second switch means to restrict movement of said gate; positioning said fifth means on said cable; positioning said sixth means on said cable; operatively connecting a cable tensioning means with said cable; incorporating an electric storage battery in said electrical circuit; incorporating a switch in said electrical circuit to direct an output shaft of said electric motor to rotate in two directions; incorporating a transformer in said electrical circuit for changing the input voltage to the transformer to an output voltage compatible with the voltage required by said electric motor; incorporating a seventh means in said electrical circuit for converting alternating current to direct current; forming said drive pulley to have, in a cross-sectional view, an elliptically shaped groove; selecting said cable having a plastic exterior; positioning said movable gate on support wheels; and, utilizing said support wheels and said cable to assist in maintaining said gate in a desired position.

What I claim is:

1. A gate apparatus comprising:

a. a movable gate;

b. a first means for positioning said gate;

c. a cable;

d. a second means for operatively connecting said cable to said gate;

e. a third means for moving said cable to move said gate;

f. said third means comprising a drive pulley for moving said cable;

g. a fourth means for receiving and for positioning said cable and for allowing said cable to move;

h. an electric motor operatively connecting with a gear box;

i. said gear box operatively connecting with a manually releaseable clutch mechanism;

j. said clutch mechanism operatively connecting with said drive pulley;

k. an electrical circuit operatively connecting with said electric motor;

l. said electrical circuit having a first switch means and a second switch means;

m. a fifth means for operatively connecting with said first switch means to restrict movement of said gate;

n. a sixth means for operatively connecting with said second switch means to restrict movement of said gate;

o. said fifth means being positioned on said cable;

p. said sixth means being positioned on said cable;

q. said electrical circuit comprising an electric storage battery operatively connecting with said electric motor;

r. a third switch means operatively connecting with said electric motor to direct an output shaft of said electric motor to rotate in two directions;

s. a transformer in said electrical circuit for changing the input voltage to the transformer to an output voltage from the transformer compatible with the voltage required by said battery; and, t. a seventh means in said electrical circuit for converting alternating current to direct current and operatively connecting with said battery.

2. A gate apparatus according to claim 1 and comprising:

a. said drive pulley having, in a cross-sectional view, an elliptically shaped groove.

3. A gate apparatus according to claim 1 and comprising:

a. said cable having a plastic exterior.

4. A gate apparatus according to claim 1 and comprising:

a. said drive pulley having, in a cross-sectional view, an elliptically shaped groove; and b. said cable having a plastic exterior.

5. A gate apparatus according to claim 1 and comprising:

a. a cable tensioning means positioned between two parts of the cable and operatively connecting together said two parts of the cable.

6. A gate apparatus according to claim 1 and comprising:

a. said drive pulley having, in a cross-sectional view, an elliptically shaped groove;

b. said cable having a plastic exterior;

c. said movable gate being positioned on support wheels; and, d. said support wheels and said cable assist in maintaining said gate in a desired position.

7. A gate apparatus according to claim 1 and comprising:

a. said drive pulley having, in a cross-sectional view, an elliptically shaped groove;

b. said cable having a plastic exterior;

c. said movable gate being suspended from a support; and, d. said support and said cable assist in maintaining said gate in a desired position.

8. A process for making a gate apparatus and comprising:

a. forming a movable gate;

b. forming a first means for positioning said gate;

c. associating in an operative relationship said first means with said gate;

d. selecting a cable;

e. forming a second means for operatively connecting said cable to said gate;

f. operatively connecting said cable to said gate;

g. selecting a third means for moving said cable for moving said gate;

h. operatively connecting said third means to said cable;

i. selecting as said third means a drive pulley for moving said cable;

j. selecting a fourth means for receiving and positioning said cable and for allowing said cable to move;

k. operatively connecting an electric motor in a drive relationship to a gear box;

l. operatively connecting said gear box with a manually releaseable clutch mechanism;

m. operatively connecting said clutch mechanism with said drive pulley;

n. operatively connecting an electric circuit with said electric motor;

o. forming said electric circuit with a first switch means and a second switch means;

p. operatively connecting a fifth means with said first switch means to restrict movement of said gate;

q. operatively connecting a sixth means with said second switch means to restrict movement of said gate;

r. positioning said fifth means on said cable;

s. positioning said sixth means on said cable;

t. incorporating an electric storage battery in said electrical circuit;

u. operatively connecting a third switch means with said electric motor to direct an output shaft of said electric motor to rotate in two directions;

v. operatively connecting a transformer in said electrical circuit for changing the input voltage to the transformer to an output voltage from the transformer compatible with the voltage required by said battery; and, w. operatively connecting a seventh means in said electrical circuit with said battery and said transformer for converting alternating current of direct current.

9. A process for making a gate apparatus according to claim 8 and comprising:

a. selecting said drive pulley to have, in a cross-sectional view, an elliptically shaped groove.

10. A process for making a gate apparatus according to claim 8 and comprising:

a. selecting said cable to have a plastic exterior.

11. A process for making a gate apparatus according to claim 8 and comprising:

a. selecting said drive pulley to have, in a cross-sectional view, an elliptically shaped groove; and, b. selecting said cable to have a plastic exterior.

12. A process for making a gate apparatus according to claim 8 and comprising:

a. operatively connecting a cable tensioning means between two parts of the cable.

13. A process for making a gate apparatus according to claim 8 and comprising:

a. selecting said drive pulley to have, in a cross-sectional view, an elliptically shaped groove;

b. selecting said cable to have a plastic exterior;

c. positioning said movable gate on support wheels; and, d. utilizing said support wheels and said cable to assist in maintaining said gate in a desired position.

14. A gate apparatus made by a process according to claim 13 and comprising:

a. selecting said drive pulley to have, in a cross-sectional view, an elliptically shaped groove;

b. selecting said cable to have a plastic exterior;

c. positioning said movable gate on support wheels; and, d. utilizing said support wheels and said cable to assist in maintaining said gate in a desired position.

15. A gate apparatus made by a process according to claim 13 and comprising:

a. selecting said drive pulley to have, in a cross-sectional view, an elliptically shaped groove;

b. selecting said cable to have a plastic exterior;

c. suspending said movable gate from a support; and, d. utilizing said support and said cable in maintaining said gate in a desired position.

16. A process for making a gate apparatus according to claim 8 and comprising:

a. selecting said drive pulley to have, in a cross-sectional view, an elliptically shaped groove;

b. selecting said cable to have a plastic exterior;

c. suspending said movable gate from a support; and, d. utilizing said support and said cable in maintaining said gate in a desired position.

17. A gate apparatus made by a process comprising:

a. forming a movable gate;

b. forming a first means for positioning said gate;

c. associating in an operative relationship said first means with said gate;

d. selecting a cable;

e. forming a second means for operatively connecting said cable to said gate;

f. operatively connecting said cable to said gate;

g. selecting a third means for moving said cable for moving said gate;

h. operatively connecting said third means to said cable;

i. selecting as said third means a drive pulley for moving said cable;

j. selecting a fourth means for receiving and positioning said cable and for allowing said cable to move;

k. operatively connecting an electric motor in a drive relationship to a gear box;

l. operatively connecting said gear box with a manually releaseable clutch mechanism;

m. operatively connecting said clutch mechanism with said drive pulley;

n. operatively connecting an electric circuit with said electric motor;

o. forming said electric circuit with a first switch means and a second switch means;

p. operatively connecting a fifth means with said first switch means to restrict movement of said gate;

q. operatively connecting a sixth means with said second switch means to restrict movement of said gate;

r. positioning said fifth means on said cable;

s. positioning said sixth means on said cable;

t. incorporating an electric storage battery in said electrical circuit;

u. operatively connecting a third switch means with said electric motor to direct an output shaft of said electric motor to rotate in two directions;

v. operatively connecting a transformer in said electrical circuit for changing the input voltage to the transformer to an output voltage from the transformer compatible with the voltage required by said battery; and, w. operatively connecting a seventh means in said electrical circuit with said battery and said transformer for converting alternating current to direct current.

18. A gate apparatus made by a process according to claim 17 and comprising:

a. selecting said drive pulley to have, in a cross-sectional view, an elliptically shaped groove.

19. A gate apparatus made by a process according to claim 17 and comprising:

a. selecting said cable to have a plastic exterior.

20. A gate apparatus made by a process according to claim 17 and comprising:

a. selecting said drive pulley to have, in a cross-sectional view, an elliptically shaped groove; and, b. selecting said cable to have a plastic exterior.

21. A gate apparatus made by a process according to claim 17 and comprising:

a. operatively connecting a cable tensioning means between two parts of the cable.

* * * * *